United States Patent [19]

Stampacchia et al.

[11] Patent Number: 4,725,069

[45] Date of Patent: Feb. 16, 1988

[54] SKI STRUCTURE

[75] Inventors: Marcello Stampacchia, Treviso; Erminio Bonsembiante, Montebelluna; Massimo Gramola, Mestre; Caterina Sabbadin, Padua; Gianfranco Benetti, Postioma, all of Italy

[73] Assignee: Marcello Stampacchia, Treviso, Italy

[21] Appl. No.: 859,155

[22] Filed: May 2, 1986

[51] Int. Cl.[4] ..... A63C 5/06

[52] U.S. Cl. ..... 280/607; 280/11.28; 280/12 H; 280/609

[58] Field of Search ..... 280/609, 607, 602, 601, 280/7.13, 7.14, 12 H, 16, 23, 87.03, 11.27, 11.28, 11.14

[56] References Cited

U.S. PATENT DOCUMENTS

| | | | |
|---|---|---|---|
| 3,030,123 | 4/1962 | Dworak | 280/16 |
| 3,336,036 | 8/1967 | Manfreda | 280/607 |
| 3,588,138 | 6/1971 | Cerny | 280/16 |
| 3,862,763 | 1/1975 | Ware | 280/11.28 |
| 4,097,055 | 6/1978 | Laycraft | 280/16 |
| 4,138,128 | 2/1979 | Criss | 280/12 H |
| 4,141,570 | 2/1979 | Sudmeier | 280/607 |

*Primary Examiner*—David M. Mitchell

*Attorney, Agent, or Firm*—Guido Modiano; Albert Josif

[57] ABSTRACT

The ski structure comprises two ski elements for resting and sliding on snow, placed the one ahead of the other and each having a slightly upturned end, on which there are made rigid supports with which lever devices are associated which are connected together to a flat plate. The lever devices are provided with shock absorbers adapted to dampen the vibrations and the stresses imposed on the two ski elements while holding the plate parallel to the axis led through the two supports. Upwardly of the plate there are provided adjustable elements for securing to it an item of footwear, while with at least one of the supports there is associated a device adapted to convert to rotary motion a side pressure exerted thereon.

16 Claims, 7 Drawing Figures

SKI STRUCTURE

BACKGROUND OF THE INVENTION

The present invention relates to a ski structure.

Skis are currently manufactured from several materials assembled together to define a single element without discontinuities, at the top of which the bindings are bonded for the ski boots to be inserted therebetween.

Such sport implements are not devoid of shortcomings: in fact, owing to their shape and construction, they transfer, to the lower limbs, all of the stresses which are imparted to them by the irregularities of the snow blanket, which stresses are the larger the higher is the speed at which one crosses these uneven expanses.

Complex are, moreover, the appropriate manoeuvres to effect a change in the direction in which one is skiing, these involving muscle loading and subsequent relaxation which cannot be learned easily.

As a partial solution to the latter problem, the trend is toward skis of increasingly smaller longitudinal dimensions, but this, besides failing to provide a radical solution for the problem, also decreases the area in contact with the snow blanket and hence the overall stability, which is the less the more frozen is the terrain, the steeper the gradient, and the faster the speed gained.

SUMMARY OF THE INVENTION

It is the main object of the present invention to remove the above-mentioned shortcomings affecting known types by providing a ski structure which stresses the lower limbs to a lesser extent.

A further important object is to provide a ski structure which allows quick and easy direction changing without involving complex manoeuvres.

These and other objects are achieved by a ski structure, which is characterized in that it comprises at least two ski elements, adapted to rest on snow and be placed one ahead of the other and having a a slightly upturned end, with said elements there being associable at least two supports, being both connected to a plate, said plate having associated therewith, adjustable clamping means for binding an item of footwear thereto.

BRIEF DESCRIPTION OF THE DRAWINGS

Further features and advantages of the invention will be apparent from the detailed description of a particular embodiment shown, by way of illustration and not of limitation, in the accompanying drawings, where.

DESCRIPTION OF THE PREFERRED EMBODIMENTS

Figure 1:
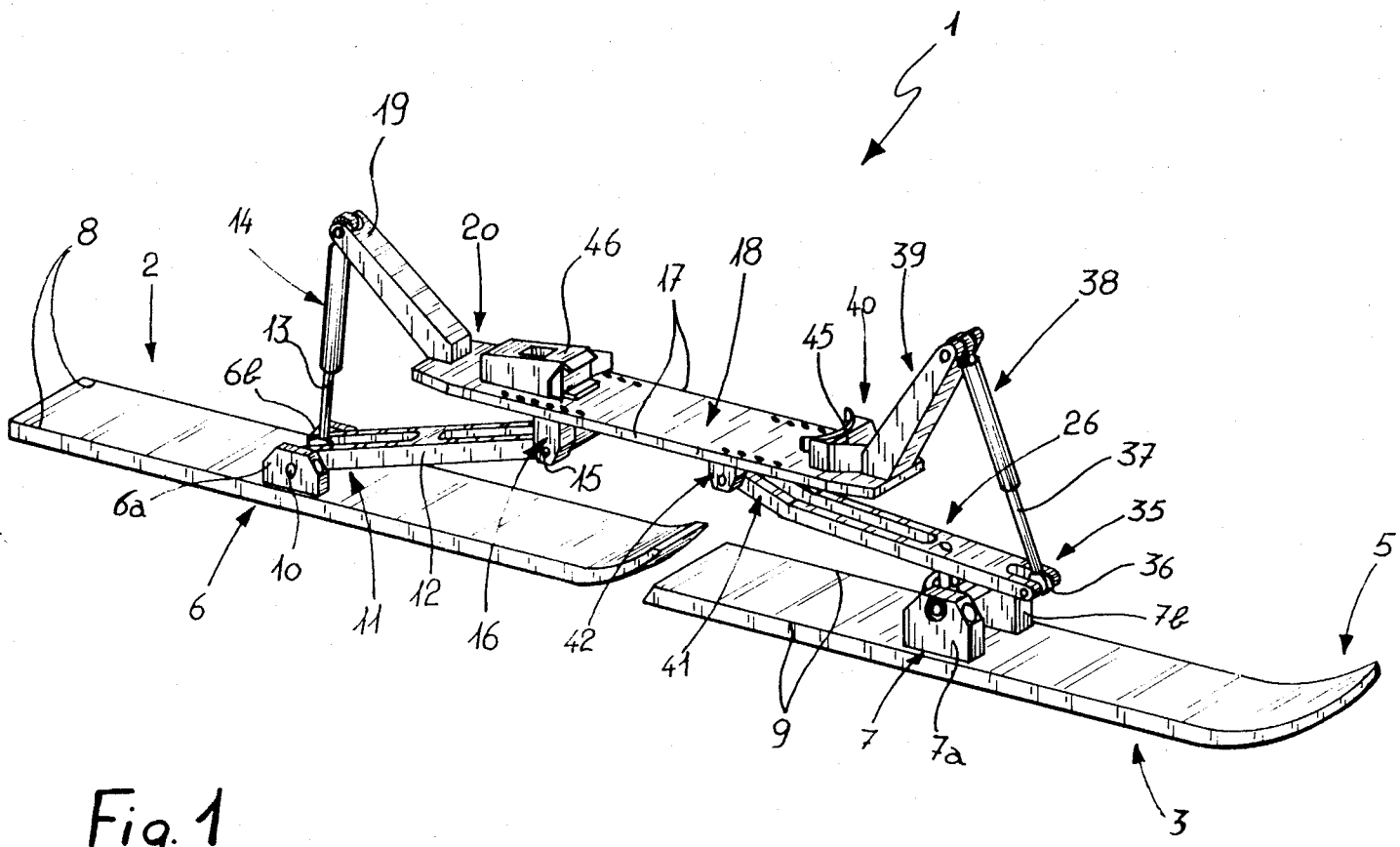
FIG. 1 is a three-quarter perspective side view of the ski structure.

With reference to the above-cited figures, the ski structure 1 comprises, in the particular embodiment, two separate elements 2 and 3 for resting and sliding on snow, both having their forward ends 4 and 5 slightly upturned.

With the top of each element 2 and 3 there is associable in a removable manner, supports 6 and 7, respectively, which each expediently comprise two metal shoulders 6*a*, 6*b* and 7*a*, 7*b* of trapezoidal shape, disposed parallel to each other and along the longitudinal side edges 8 and 9 of the elements 2 and 3.

Between the shoulders 6*a* and 6*b*, there is a fixed pin 10 on which the ends 11 of a first metal bar 12 of parallelepipedal shape, and the matingly shaped end of the stem 13 of a shock absorber 14 are journalled idly.

At its other end, the bar 12 is journalled to a second pin 15 spanning between two more shoulders 16, similar to the shoulders 6*a*, 6*b* but being upside down with respect thereto, said shoulders 16 being associated, in the proximity of side edges 17, with the bottom surface of a metal plate 18 preferably of parallelepipedal shape with bevelled corners.

The other end of the shock absorber 14 is instead journalled idly to the corresponding end of a second bar 19, inclined and attached at the other end to the top surface of the plate 18, close to a rear zone 20 thereof.

Between the shoulders 7*a* and 7*b* of the support 7, there is disposed a means for changing direction 21 composed of a first pin 22 advantageously of metal and defining an L-like section comprising an obtuse angle between its wings 23 and 24, respectively the minor and major wings.

The end 25 of the wing 23, of conical shape, houses in a matingly shaped seat formed downwardly of a second, preferably metal, bar 26 at its longitudinal mid-axis, between the two there being interposed a shim 27 which may be formed, for example, of plastic material. With the wing 24, of annular shape, there is associated, close to the wing 23, a pin 28 journalled to the shoulders 7*a* and 7*b* and placed perpendicularly therebetween; into the ring 29 of the wing 24 there is inserted perpendicularly, an elastic swivel joint 30 advantageously of cylindrical shape, along the centre axis of which there is inserted a second pin 31 adapted for clamping, downwardly, with the head 32 and upwardly with a threaded nut 33, the swivel joint itself. The latter may comprise two half-cylinders 30*a* and 30*b*. The end 34 of the second pin is threaded and associated with the bar 26 at its longitudinal mix-axis.

On the end 35 of the bar 26 there is journalled idly the end 36 of a stem 37 of a shock absorber 38.

The latter is then journalled to the end of an inclined bar 39, similar to the bar 19, projecting upwardly and being rigidly associated with the surface of the plate 18, at a location close to its forward zone 40.

The other end 41 of the bar 26, slightly inclined with respect to the end 35, is journalled between two more shoulders 42, similar to the shoulders 16 in shape, but associated downwardly with the forward zone 40 of the plate 18.

Both the shoulders 16 and 42 may be associated, such as by bolts or screws, with either rear 43 and front 44 pairs of seats formed laterally of the plate 18.

On the latter, there are removably associated binding means which are adjustable, for an item of footwear, it being possible for such means to comprise, for example, a toe piece 45 and a heel piece for a ski boot 47.

Below the zone 40 of the plate 18, a layer 48 of an elastically deformable material such as plastic is provided.

Figure 2:
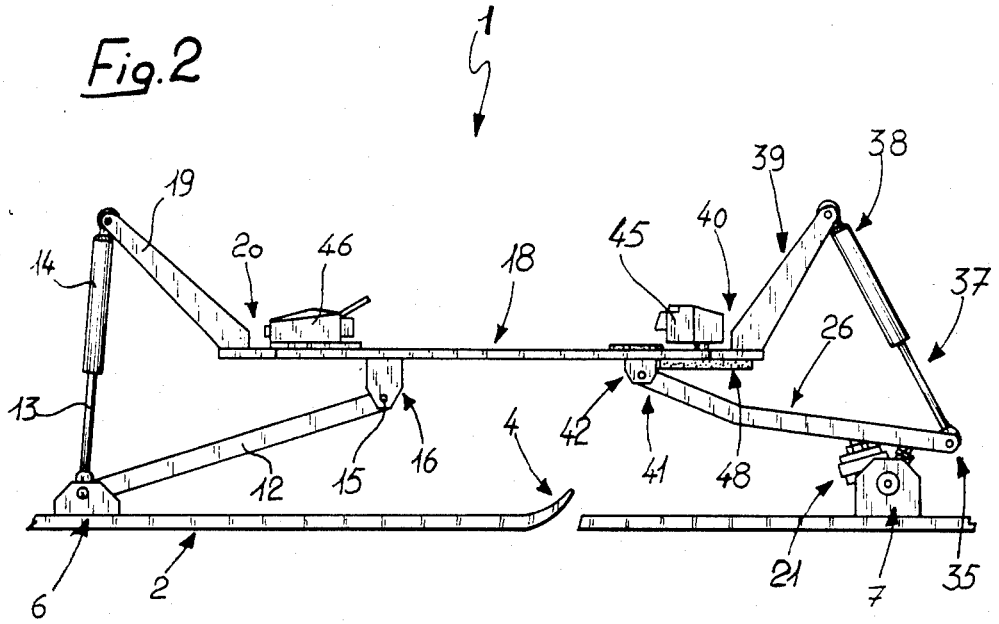
FIG. 2 is a partial side view of the invention in its condition of non-use.

The ski structure operates as follows: after the user has associated the item of footwear with the plate 18, the shock absorbers 14 and 38 will position themselves at an intermediate position to those shown in FIGS. 2 and 3 so as compensate for the skier's weight.

Such shock absorbers, together with the bars 12, 19,26 and 39 permit, in fact, vertical translation of the plate 18, this remaining in all cases always substantially parallel to the axis extending between the supports 6 and 7.

Figure 3:
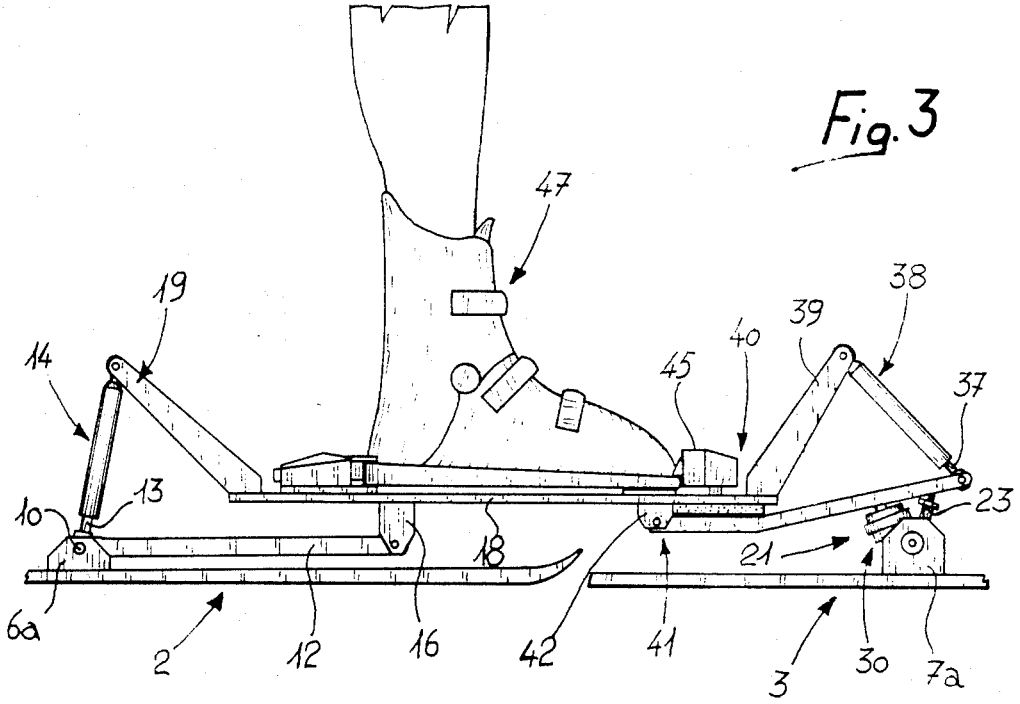
FIG. 3 is a similar view to the preceding ones showing the arrangement of the lever devices and means associated therewith while being stressed.

Any stresses imposed on the ski 2 by the irregularity of the snow blanket will then be absorbed by the plungers 14 and 38, the layer 48 further absorbing any stresses, once they have reached the travel limit of the plungers, as shown in FIG. 3.

In practice, the ski's direction can be controlled by a skier by merely shifting the body weight laterally of the plate 18: thus, the pin 34 will undergo a displacement with respect to its rest position (shown in FIG. 1), that displacement being transmitted, through the swivel joint 30, to the pin 22, then to the shoulders 7*a*,7*b* and hence to the element 3.

Figure 4:
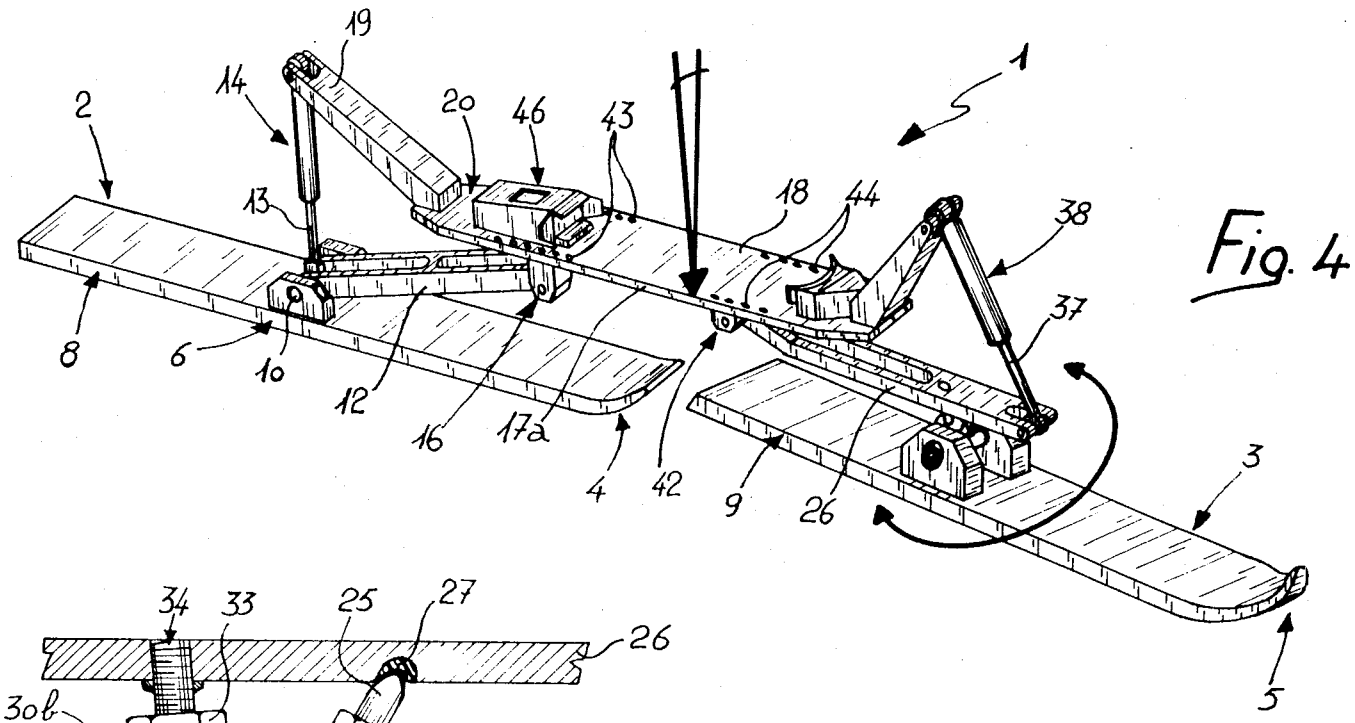
FIG. 4 is a similar view to FIG. 1 showing the operation for changing direction.
Figure 5:
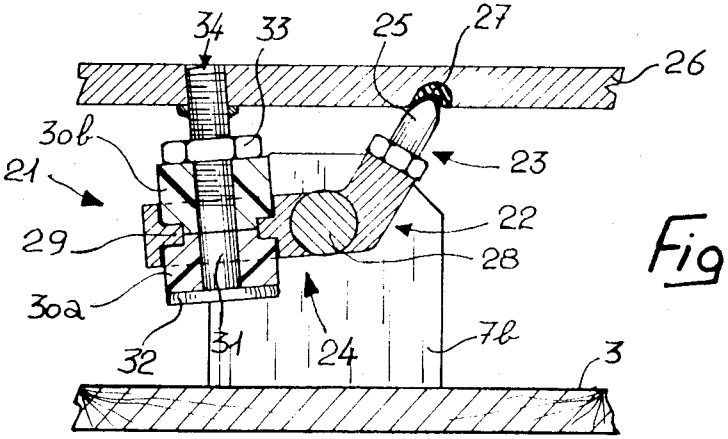
FIG. 5 is a partial-sectional view of the menas which converts to rotary motion a pressure exerted laterally on the plate.

That movement is shown in FIG. 4, a pressure applied to the side 17*a* causing the element 3 to rotate in a clockwise direction.

It has thus been shown that the ski according to the invention achieves all of its objects, it allowing per se the stresses imposed on the elements 2 and 3 contacting the snow surface to be absorbed without transmitting them, except for a minimal part, to the user's lower limbs.

Furthermore, the ease with which one can effect a change of direction makes it a very simple implement to use, also and especially for those who approach the practice of skiing for the first time, it requiring no particular technical instructions nor any specific training.

Of course, the invention herein is susceptible to many modifications and changes, all of which fall within the same inventive concept.

Thus, as an example, the binding of clamping means associated with the plate 18 may have a different shape and be adapted for different items of footwear from the ski boot 47 shown in FIG. 3.

Or the shock absorbers 14 and 38 may be replaced with like means adapted to absorb stresses elastically.

The means for combining the direction 21 could also be applied at the shoulders 6*a* and 6*b*, while there could be applied between the two elements 2 and 3 an elastically deformable connecting means.

Figure 6:
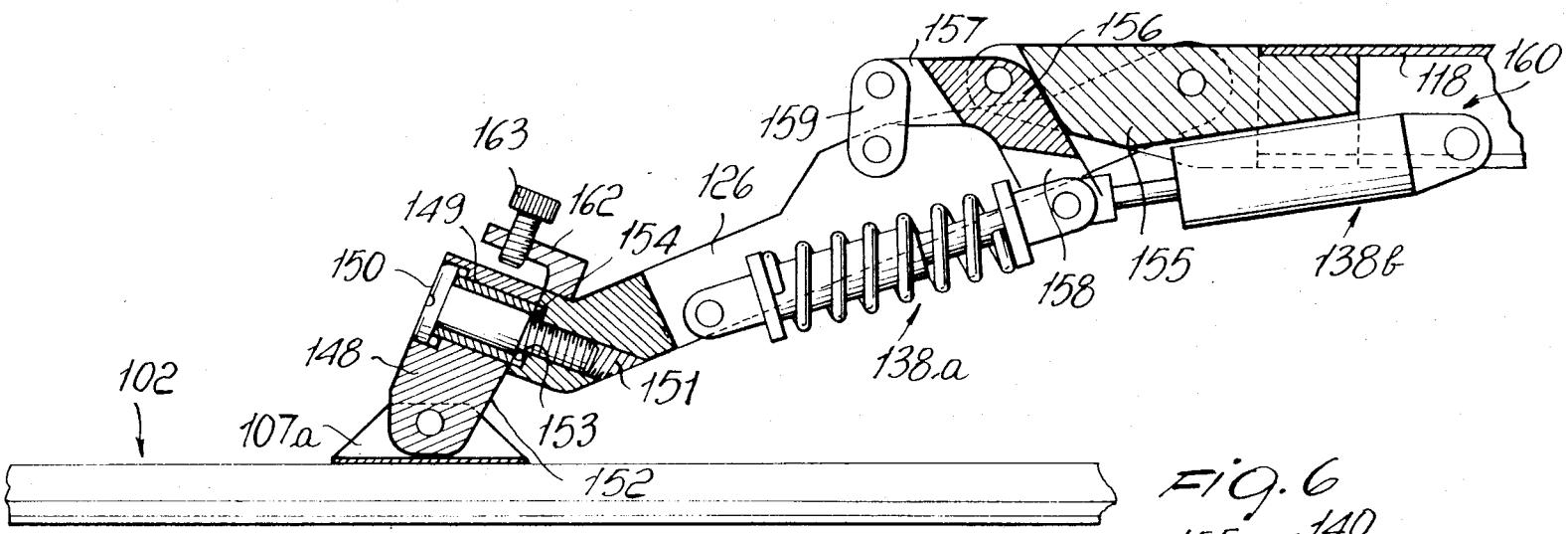
FIGS. 6 and 7 show another embodiment of the ski structure.
Figure 7:
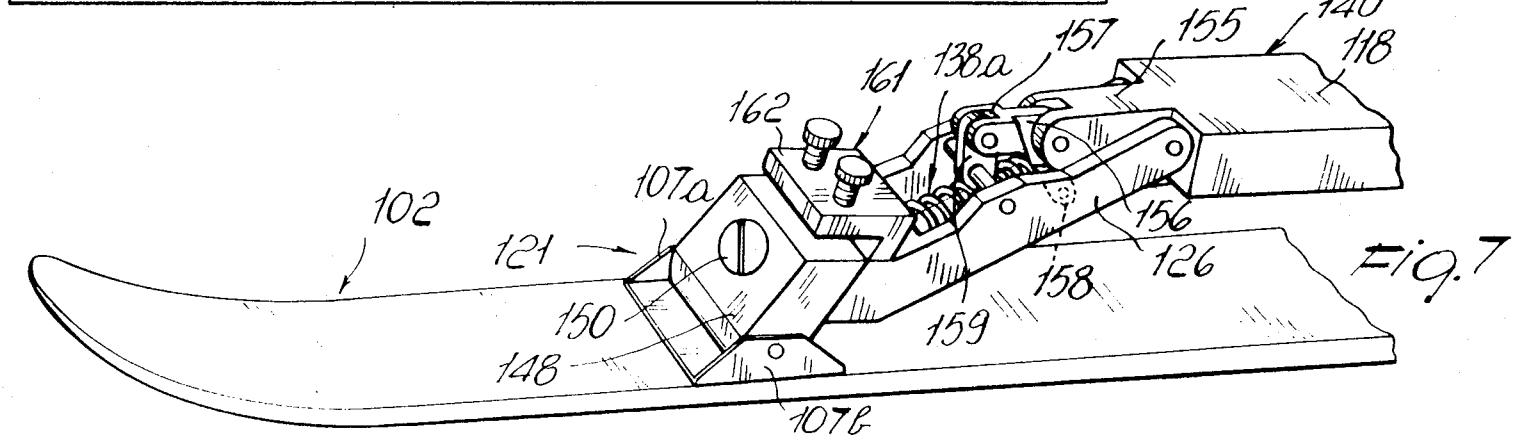

FIGS. 6 and 7 show a modified form of a ski 101.

The forward element 102 has a means for changing direction 121 composed of a body 148 journalled idly between the shoulders 107*a* and 107*b*.

On the forward surface of said body, there is formed the seat for a bushing 149 advantageously of bronze and being the seat for a bolt 150 adapted to secure the end of a bar 126 to the body 148.

The bolt 150 preferably has a shank of larger diameter than its terminating end portion to define a step-like break and a slightly inclined longitudinal axis with respect to the plane of lay of the element 102, the terminating end of said bolt being threaded and associable with a matingly threaded seat 151 formed at the longitudinal mid-axis of the end of the bar 126.

The bolt 150 is also positioned at axis through the centre of the body 148.

In order to enable the end of the bar 126 to rotate on the rear surface 152 of the body 148, it is envisaged that a washer 153 which may be of steel, be positioned in a prearranged seat 154 formed in the end of the bar 126, that washer interacting with the step-like break on the bolt 150.

The other end of the bar 126 is composed of two parallel wings journalled idly to an arm 155 projecting at the end of the forward zone 140 of the plate 118.

At the terminating end of the arm 155 there is also journalled idly a first connecting rod 156.

That connecting rod, advantageously having a substantially L-like shape, and being journalled on the arm 155 at the junction point of its wings 157 and 158.

Journalled idly on the wing 157 is one end of a second connecting rod 159, having a linear shape and extending perpendicularly to the element 102, its other end being journalled idly between the wings of the bar 126.

On the end of the wing 158 there are journalled idly, instead, the ends of a compression shock absorber 138*a* and that of a hydraulic shock absorber 138*b*.

The other ends of such shock absorbers are journalled idly, respectively between the wings of the bar 126 close to the end thereof associated with the body 148 and between the walls of a prearranged seat 160 formed at the bottom surface of the plate 118.

The geometric arrangement of the various connecting rods 156 and 159, bar 126, arm 155, and shock absorbers 138*a* and 138*b* enables a displacement along parallel planes of the plate 118.

On the user shifting the body weight laterally of the plate 118, he will consequently impose a rotation on the bar 126; owing to the inclination of the bolt 150, the rotation of the end of the bar 126 results in an angular displacement across the rest surface of the element 102.

Above the end of the bar 126, there is secured an element 161 of L-like shape, the wing 162 being laid parallel to the top surface of the body 148.

At this wing there are formed, close to its side edges, two throughgoing threaded holes for a pair of bolts 163; the latter form a travel limiter and accordingly, enable, depending on a desired inclination for the bar 126, the rotation on the rest surface of the element 102 not to increase as the angle imposed on the bar 126 itself increases, but also imparting to the element 102 itself an inclination on the rest surface.

Thus, the possibility is also achieved of effecting a skiing stride by "edging in" the forward element 102. Also in this case, the set objectives have been achieved of enabling the angle to be imparted to the plate 118 to be determined prior to the element 102 being also inclined with respect to the rest surface.

Of course, the materials and dimensions may be any ones according to requirements; furthermore, all the details may be replaceable with other technically equivalent elements.

We claim:

1. A ski structure comprising at least one ski element and at least one other ski element adapted for resting on snow, at least one plate having a side edge and an end, at least two supports and adjustable clamping means, said at least one ski element being placed ahead of said other ski element and having a slightly upturned end, said at least two supports being associated with said at least one ski element and said at least one other ski element and both connected to said plate, said adjustable clamping means being associated with said plate and adapted for binding an item of footwear thereto, said supports further comprising a lever device, said lever device comprising a first bar having at least one end and at least one other end, a pin, and means adapted to convert pressure applied close to said edge of said plate into a turning of the ski to effect steering, said at least one end of said first bar being journalled idly on said pin, said pin being associated with said means adapted to convert into rotary motion, a pressure applied close to said side edge of said plate, said other end of said first bar being journalled below said plate, said lever device further comprising a second bar having a free end, and means adapted to dampen vibrations and stresses having an end, said second bar being secured to said end of said plate on said free end of said second bar there being journalled said end of said means adapted to dampen vibrations and stresses.

2. A ski structure comprising at least one ski element and at least one other ski element adapted for resting on snow, at least one plate having a side edge and an end, at least two supports and adjustable clamping means, said at least one ski element being placed ahead of said other ski element and having a slightly upturned end, said at least two supports being associated with said at least one ski element and said at least one other ski element and both connected to said plate, said adjustable clamping means being associated with said plate and adapted for binding an item of footwear thereto, said supports further comprising means for turning the ski to effect steering composed of a metal body having a transverse mid-plane, at least one seat, at least two integral shoulders defining a rest surface, a T-shaped bushing, a bolt having a threaded end, a matingly threaded seat, a tie bar having a mid-axis, at least one end and at least one other end defining two wings, and an arm, said metal body being journalled idly between said at least two integral shoulder, said seat being formed at said transverse mid plane of said body, inclined with respect to said rest surface defined by said shoulders, and adapted for at least partially accommodating said T-shaped bushing, said bolt being adapted to interact with said T-shaped busing, said threaded end being associable with said matingly threaded seat, said matingly threaded seat being formed at said mid-axis of said end of said tie bar said two wings being journalled idly on said arm, said arm projecting at said forward zone of said plate in the direction of said longitudinal mid-axis thereof.

3. A ski structure comprising at least one ski element and at least one other ski element adapted for resting on snow, at least one plate having a side edge, a forward zone and an end, at least two supports and adjustable clamping means, said at least one ski element being placed ahead of said other ski element and having a slightly upturned end, said at least two supports being associated with said at least one ski element and said at least one other ski element and both connected to said plate, said adjustable clamping means being associated with said plate and adapted for binding an item of footwear thereto, said supports further comprising means for changing direction composed of a metal body having a transverse mid-plane, at least one seat, at least two shoulders defining a rest surface, a T-shaped bushing, a bolt having a threaded end, a matingly threaded seat, a tie bar having a mid-axis, at least one end and at least one other end defining two wings, and an arm, said metal body being journalled idly between said at least two shoulders, said seat being formed on said transverse mid-plane of said body, inclined with respect to said rest surface defined by said shoulders, and adapted for at least partially accommodating said T-shaped bushing, said bolt being adapted to interact with said T-shaped bushing, said threaded end being associable with said matingly threaded seat, said matingly threaded seat being formed at said mid-axis at said end of said tie bar, said two wings being journalled idly on said arm, said arm projecting at said forward zone of said plate according to said longitudinal mid-axis thereof, said ski structure further comprising an L-shaped element including a wing having side edges, throughgoing seats and travel limiters, said at least one end of said tie-bar being adapted for interacting with said metalbody, said L-shaped element being rigidly associated with said at least one end of said tie bar, said metal body having a top flat surface, said wing being placed parallel to said top flat surface of said body, said throughgoing seats being formed proximately to said side edges of said wing, said throughgoing seats being threaded for engagement with said travel limiters, said travel limiters comprising bolts.

4. A ski structure comprising at least one ski element and at least one other ski element adapted for resting on snow, at least one plate having a side edge , a forward zone and an end, at least two supports and adjustable clamping means, said at least one ski element being placed ahead of said other ski element and having a slightly upturned end, said at least two supports being associated with said at least one ski element and said at least one other ski element and both connected to said plate, said adjustable clamping means being associated with said plate and adapted for binding an item of footwear thereto, said supports further comprising means for turning the ski to effect steering composed of a metal body having a transverse midplane, at least one seat, at least two shoulders defining a rest surface, a T-shaped bushing, a bolt having a threaded end, a matingly threaded seat, a tie bar having a mid-axis, at least one end and at least one other end defining two wings, and an arm, said metal body being journalled idly between said at least two shoulders, said seat being formed on said transverse mid-plane of said body, inclined with respect to said rest surface defined by said shoulders, and adapted for at least partially accommodating said T-shaped bushing, said bolt being adapted to interact with said T-shaped bushing, said threaded end being associable with said matingly threaded seat, said matingly threaded seat being formed at said mid-axis at said end of said tie bar, said two wings being journalled idly on said arm, said arm projecting from said forward zone of said plane and having an end, on said end there being journalled idly a first connecting rod having at least one first connecting rod wing and at least one other first connecting rod wing, said at least one first connecting rod wing being journalled idly to a second linear connecting rod, said second linear connecting rod being in turn journalled idly on said tie bar, said ski structure further comprising a seat having seat surfaces a first shock absorber having one first shock absorber end and one other first shock absorber end, and a second shock absorber having one second shock absorber end and one other second shock absorber end, said at least one other first connecting rod wing being journalled to said one first shock absorber end and to said one second shock absorber end said one other first shock absorber end being journalled between said at least two wings of said tie bar proximate to said means for changing direction said one other second shock absorber end being journalled between said seat surfaces said seat being formed downwardly of said plate, at said longitudinal midaxis thereof.

5. A ski structure comprising at least one plate having ends, said ends including at least one end and at least one other end, ski elements, said ski elements including at least one ski element and at least one other ski element, and at least one articulation means and at least one other articulation means, said at least one ski element being placed ahead of said other ski element and having an upturned end, said at least one articulation means being adapted for operatively connecting said at least one ski element to said at least one end of said plate, said at least one other articulation means being adapted for operatively connecting said at least one other ski to said at least one other end of said plate, said at least one articulation means and said at least one other articulation means each comprising at least one body, at least two shoulders, a bar defining at least one extremity and at least one other extremity, a first connecting rod having at least one end, at least one portion, and at least one other porton, a second connecting rod having at least one rod end and at least one other rod end, and shock absorber means including at least one end portion and at least one other end portion, said at least two shoulders, being rigidly associated with one of said ski elements said body being journalled on said at least two shoulders, said extremity of said bar being articulated to said body, said at least one rod end of said connecting rod being pivotally connected to said bar, said at least one portion of said first connecting rod being pivotally connected to said at least one other rod end of said second connecting rod, said end of said first connecting rod being pivotally connected to said end portion of said shock absorber means, said other end portion of said shock absorber means, said other extremity of said bar and said other portion of said first connecting rod each being pivotally connected to said plate.

6. A ski structure according to claim 5, wherein said shock absorber means comprises at least one compression shock absorber operatively connected between said end of said first connecting rod and said plate, and wherein said first connecting rod is further operatively connected between said other rod end of said second connecting rod and said plate.

7. A ski structure according to claim 6 wherein said compression shock absorber is adapted to lie in a plane extending substantially parallel to said ski elements upon said plate being made to bear at least a portion of a skiers weight.

8. A ski structure according to claim 5 wherein said bar defines, between said extremity and said other extremity, an intermediate portion, said rod end of said second connecting rod being pivotally journalled to said intermediate portion of said bar, said other rod end of said second connecting rod being journalled to said portion of said first connecting rod, said shock absorber means being operatively interposed between said end of said first connecting rod and said plate.

9. A ski structure according to claim 5 wherein said first connecting element is adapted for operatively interconnecting said other rod end of said second connecting rod, said end portion of said shock absorber means and said plate, and wherein said bar is adapted for operatively interconnecting, said body, said rod end of said second connecting rod and said plate.

10. A ski structure according to claim 5, further comprising means for turning the ski to effect steering composed of, at least one seat, a T-shaped bushing, a bolt having a threaded end, a matingly threaded seat, a tie bar having a mid-axis at least one end and at least one other end defining two wings, and an arm said at least one ski element defining a rest surface, said seat being formed on said body, inclined with respect to said rest surface and adapted for at least partially accommodating said T-shaped bushing, said bolt being adapted to interact with said T-shaped bushing, said threaded end being associable with said matingly threaded seat, said matingly threaded seat being formed on said bar, said two wings being journalled idly to said plate.

11. A ski structure according to claim 10, further comprising an L-shaped element including a wing having side edges, throughgoing seats and travel limiters, said at least one end of said bar being adapted for interacting with said body, said L-shaped element being rigidly associated with said at least one other end of said tie bar, said body having a top flat surface, said wing being placed parallel to said top flat surface of said body, said throughgoing seats being formed proximately to said side edges of said wing, said throughgoing seats being threaded for engagement with said travel limiters.

12. A ski structure according to claim 10 further comprising an L-shaped element including a wing having side edges, throughgoing seats and travel limiters, said at least one end of said bar being adapted for interacting with said body, said L-shaped element being rigidly associated with said at least one other end of said tie bar, said body having a top flat surface, said wing being placed parallel to said top flat surface of said body, said throughgoing seats being formed proximately to said side edges of said wing, said throughgoing seats being threaded for engagement with said travel limiters, said travel limiters comprising bolts.

13. A ski structure comprising at least one plate having ends, said ends including at least one end and at least one other end, ski elements, said ski elements including at least one ski element and at least one other ski element, and at least one articulation means and at least one other articulation means, said at least one ski element being placed ahead of said other ski element and having an upturned end, said at least one articulation means being adapted for operatively connecting said at least one ski element to said at least one end of said plate, said at least one other articulation means being adapted for operatively connecting said at least one other ski to said at least one other end of said plate, said at least one articulation means and said at least one other articulation means each comprising at least one body, at least two shoulders a bar defining at least one extremity and at least one other extremity, a first connecting rod having at least one end, at least one portion, and at least one other porton, a second connecting rod having at least one rod end and at least one other rod end, and shock absorber means including at least one end portion and at least one other end portion, said at least two shoulders being rigidly associated with one of said ski elements said body being journalled on said at least two shoulders, said extremity of said bar being articulated to said body, said at least one rod end of said connecting rod being pivotally connected to said bar, said at least one portion of said first connecting rod being pivotally connected to said at least one other rod end of said second connecting rod, said end of said first connecting rod being pivotally connected to said end portion of said shock absorber means, said other end portion of said shock absorber means, said other extremity of said bar and said other portion of said first connecting rod each being pivotally connected to said plate, wherein said shock absorber means comprises at least one compression shock absorber operatively connected between said end of said first connecting rod and said plate, and wherein said first connecting rod is further operatively means each comprising at least one body, at least two shoulders a bar defining at least one extremity and at least one other extremity, a first connecting rod having at least one end, at least one portion, and at least one other porton, a second connecting rod having at least one rod end and at least one other rod end, and shock absorber means including at least one end portion and at least one other end portion, said at least two shoulders being rigidly associated with one of said ski elements said body being journalled on said at least two shoulders, said extremity of said bar being articulated to said body, said at least one rod end of said connecting rod being pivotally connected to said bar, said at least one portion of said first connecting rod being pivotally connected to said at least one other rod end of said second connecting rod, said end of said first connecting rod being pivotally connected to said end portion of said shock absorber means, said other end portion of said shock absorber means, said other extremity of said bar and said other portion of said first connecting rod each being pivotally connected to said plate, wherein said shock absorber means comprises at least one compression shock absorber operatively connected between said end of said first connecting rod and said plate, and wherein said first connecting rod is further operatively connected between said other rod end of said second connecting rod and said plate.

14. A ski structure according to claim 13 wherein said compression shock absorber is adapted to lie in a plane extending substantially parallel to said ski elements upon said plate being made to bear at least a portion of a skiers weight.

15. A ski structure according to claim 13 wherein said bar defines, between said extremity and said other extremity, an intermediate portion, said rod end of said second connecting rod being pivotally journalled to said intermediate portion of said bar, said other rod end of said second connecting rod being journalled to said portion of said first connecting rod, said shock absorber means being operatively interposed between said end of said first connecting rod and said plate.

16. A ski structure according to claim 13 wherein said first connecting element is adapted for operatively interconnecting said other rod end of said second connecting rod, said end portion of said shock absorber means and said plate, and wherein said bar is adapted for operatively interconnecting, said body, said rod end of said second connecting rod and said plate.

* * * * *